US005983575A

United States Patent [19]

Reppas

[11] Patent Number: 5,983,575

[45] **Date of Patent: *Nov. 16, 1999**

[54] RETRACTABLE DOME

[76] Inventor: George S. Reppas, 1030 San Raymundo Rd., Hillsborough, Calif.

[ * ] Notice: This patent is subject to a terminal disclaimer.

[21] Appl. No.: 09/114,677

[22] Filed: Jul. 13, 1998

Related U.S. Application Data

[63] Continuation of application No. 08/741,380, Oct. 29, 1996, Pat. No. 5,778,603.

[51] Int. Cl.[6] ..... E04H 3/10; E04B 7/16

[52] U.S. Cl. ..... 52/66; 52/6; 52/64; 52/81.1

[58] Field of Search ..... 52/6, 64, 66, 67, 52/71, 80.1, 81.1, 174, 175

[56] References Cited

U.S. PATENT DOCUMENTS

| | | | |
|---|---|---|---|
| 2,728,115 | 12/1955 | Cornelius | 52/67 |
| 3,195,275 | 7/1965 | Praeger . | |
| 3,422,581 | 1/1969 | Allen . | |
| 3,552,072 | 1/1971 | O'Connell . | |
| 3,566,555 | 3/1971 | Schultz et al. . | |
| 3,766,691 | 10/1973 | Ray | 52/66 X |
| 4,075,795 | 2/1978 | Thomas . | |
| 4,175,361 | 11/1979 | Kumode | 52/66 |
| 4,204,372 | 5/1980 | Agopyan . | |
| 4,257,199 | 3/1981 | Kuboyama . | |
| 4,306,390 | 12/1981 | Brown | 52/66 X |
| 4,616,451 | 10/1986 | Glick | 52/66 |
| 4,676,033 | 6/1987 | Allen et al. . | |
| 4,682,449 | 7/1987 | Berger . | |
| 4,706,419 | 11/1987 | Adachi et al. . | |
| 4,716,693 | 1/1988 | Webster | 52/64 |
| 4,727,688 | 3/1988 | Kida et al. | 52/6 |
| 4,738,057 | 4/1988 | Logan . | |
| 4,751,800 | 6/1988 | Kida et al. . | |
| 4,802,314 | 2/1989 | Schildge, Jr. . | |
| 4,831,792 | 5/1989 | Berger . | |
| 4,833,837 | 5/1989 | Bonneau | 52/66 X |
| 4,995,203 | 2/1991 | Brisbin et al. . | |
| 5,063,730 | 11/1991 | Muramoto et al. | 52/6 X |
| 5,070,659 | 12/1991 | Brisbin et al. . | |
| 5,076,031 | 12/1991 | Hancock . | |
| 5,103,600 | 4/1992 | Geiger et al. . | |
| 5,167,097 | 12/1992 | Robbie et al. . | |
| 5,226,262 | 7/1993 | Kelley . | |
| 5,257,481 | 11/1993 | Reppas et al. | 52/6 |
| 5,351,449 | 10/1994 | Allen et al. . | |
| 5,355,641 | 10/1994 | Levy . | |
| 5,394,660 | 3/1995 | Haris | 52/6 X |
| 5,625,982 | 5/1997 | Foote | 52/67 X |
| 5,778,603 | 7/1998 | Reppas | 52/66 |

FOREIGN PATENT DOCUMENTS

| | | |
|---|---|---|
| 2444763 | 8/1980 | France . |

*Primary Examiner*—Carl D. Friedman
*Assistant Examiner*—Kevin D. Wilkens
*Attorney, Agent, or Firm*—Harness, Dickey & Pierce, P.L.C.

[57] ABSTRACT

A retractable dome stadium having a plurality of generally lune-shaped panels mounted for movement between an open position in which they are stacked one above the other in a superimposed relationship and a closed position in which they are disposed in a generally side-by-side relationship. In the open position, the dome has a low and open view in one end thereof.

20 Claims, 6 Drawing Sheets

Fig-4
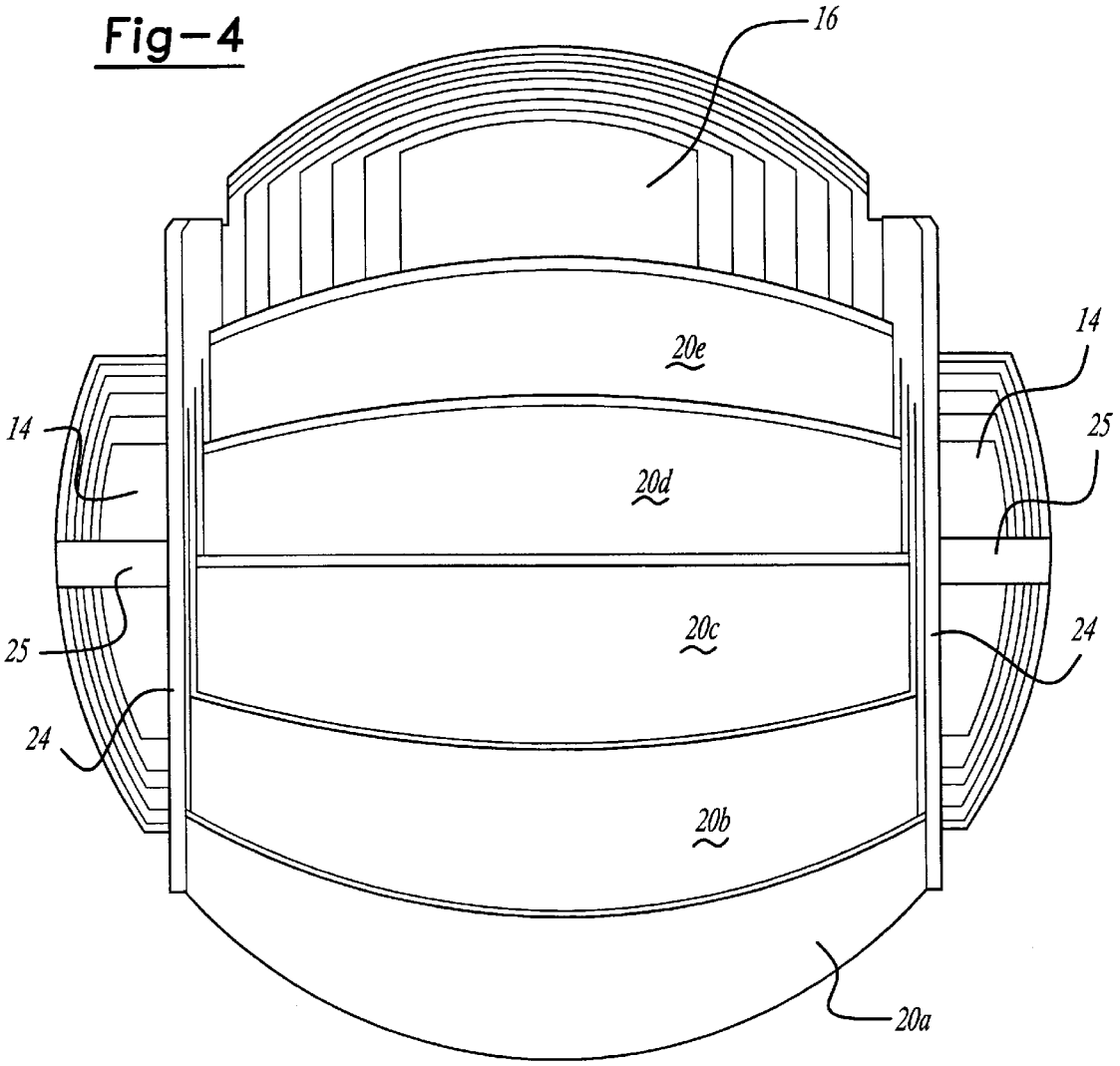
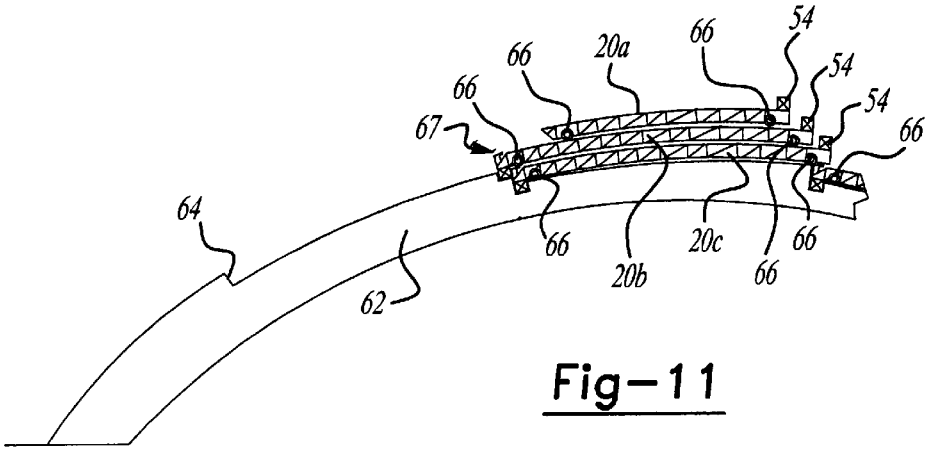
Fig-11

RETRACTABLE DOME

This is a continuation of U.S. patent application Ser. No. 08/741,380, filed Oct. 29, 1996, U.S. Pat. No. 5,778,603.

BACKGROUND OF THE INVENTION

FIELD OF THE INVENTION

The present invention relates to dome stadiums and, more particularly, to a retractable dome structure.

BACKGROUND AND SUMMARY OF THE INVENTION

The desirability of providing an arena or stadium which can be fully opened to the sun and fresh air in times of good weather and yet can be closed or partially closed, in times of inclement weather or excessive wind, is widely recognized as shown in U.S. Pat. No. 5,257,481 issued to the inventor of the present invention. To accomplish this goal is very difficult because of the massive size of such structures. It is also desirable to provide a retractable dome that has a low and open view in one end thereof. This allows fans to see the skyline of a city or other scenic views when the dome is open.

Accordingly, it is an object of this invention to provide a relatively simple design for such a stadium which is capable of being fully open as well as fully closed and which when open has a low and open view in one end of the stadium or arena allowing fans to see the skyline or other scenic view when the dome is open.

It is an additional object of the present invention to provide a reinforcement structure for the retractable panels of the dome.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 4 is a similar view to FIG. 3 but showing the dome in a closed position;

FIGS. 9–11 schematically illustrate the stacking of the lune-shaped panels during the retraction of the dome panels.

DETAILED DESCRIPTION OF THE PREFERRED EMBODIMENTS

The present invention is applicable to virtually any type of stadium or the like and for exemplary purposes is illustrated embodied in the athletic stadium in FIGS. 1–8. The stadium generally comprises an activity surface in the form of a playing area 10, a plurality of tiers of seating 12, private seating boxes, side parking levels 14 with connecting rear parking levels 16, pedestrian ramps connecting the tiers of seating 12 with the side and rear parking levels 14, 16 concourses that can accommodate concession stands and restrooms, and like features common to most stadiums. Side and rear parking levels 14, 16 are interconnected with each other and are designed to allow patrons to park in close proximity to their individual seats. Preferably, patrons can enter the stadium from any street entrance and have access to each of the side and rear parking levels 14, 16. The number of levels of parking tiers in each of the side and rear parking levels 14, 16 can be varied as required by the surrounding landscaping. Each of the levels of parking can be connected to upper and lower levels by ramps (not shown).

Figure 1:
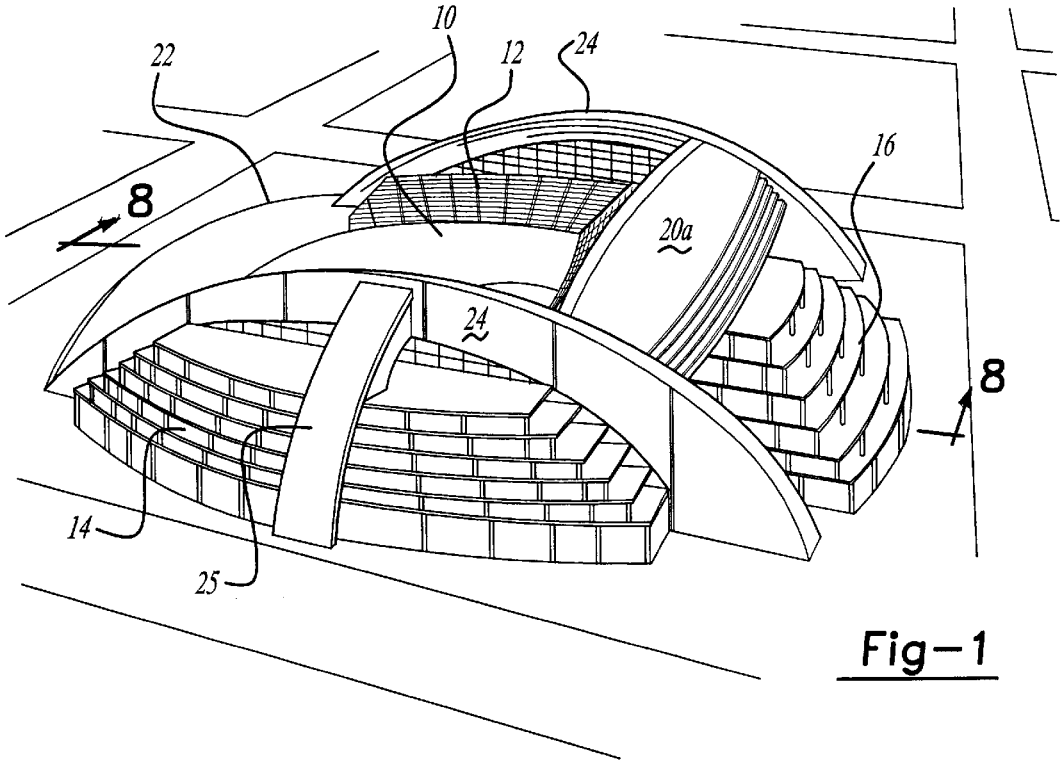
FIG. 1 is a pictorial view of a retractable dome stadium embodying the principles of the present invention, showing the dome in an open position.
Figure 2:
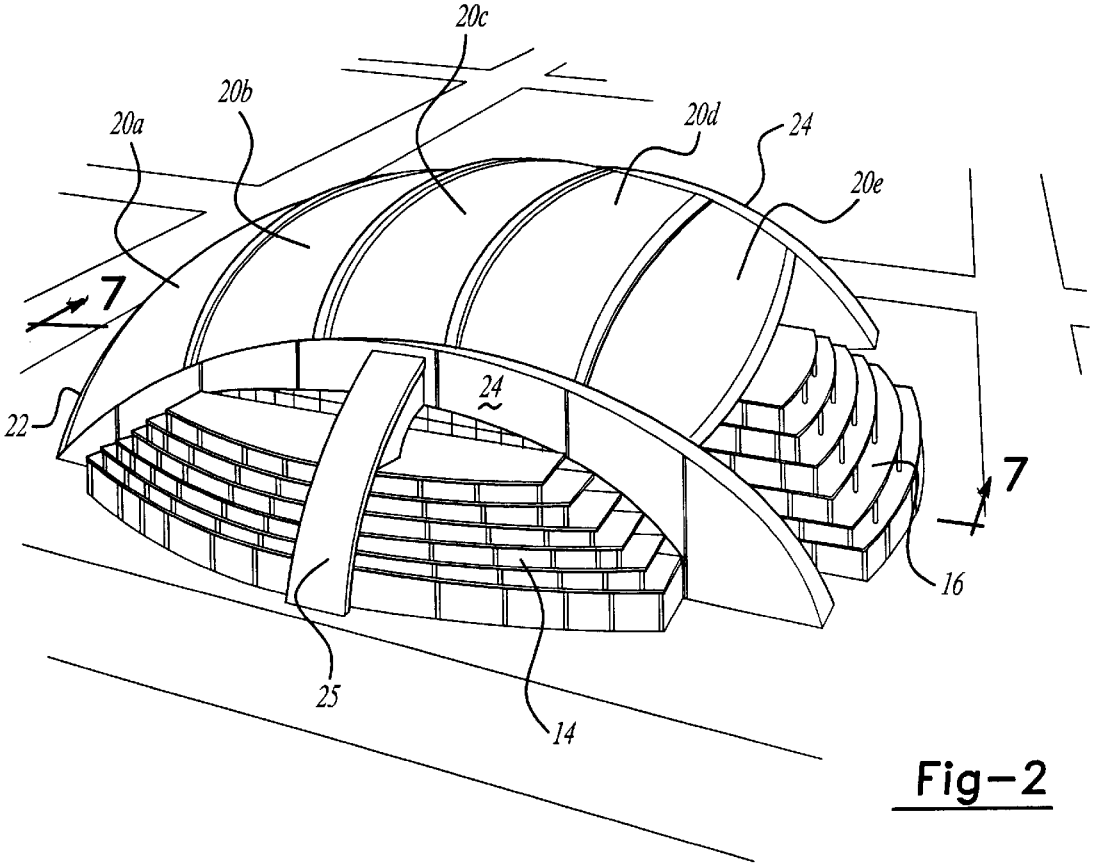
FIG. 2 is a view similar to FIG. 1 but showing the dome in a closed position.
Figure 3:
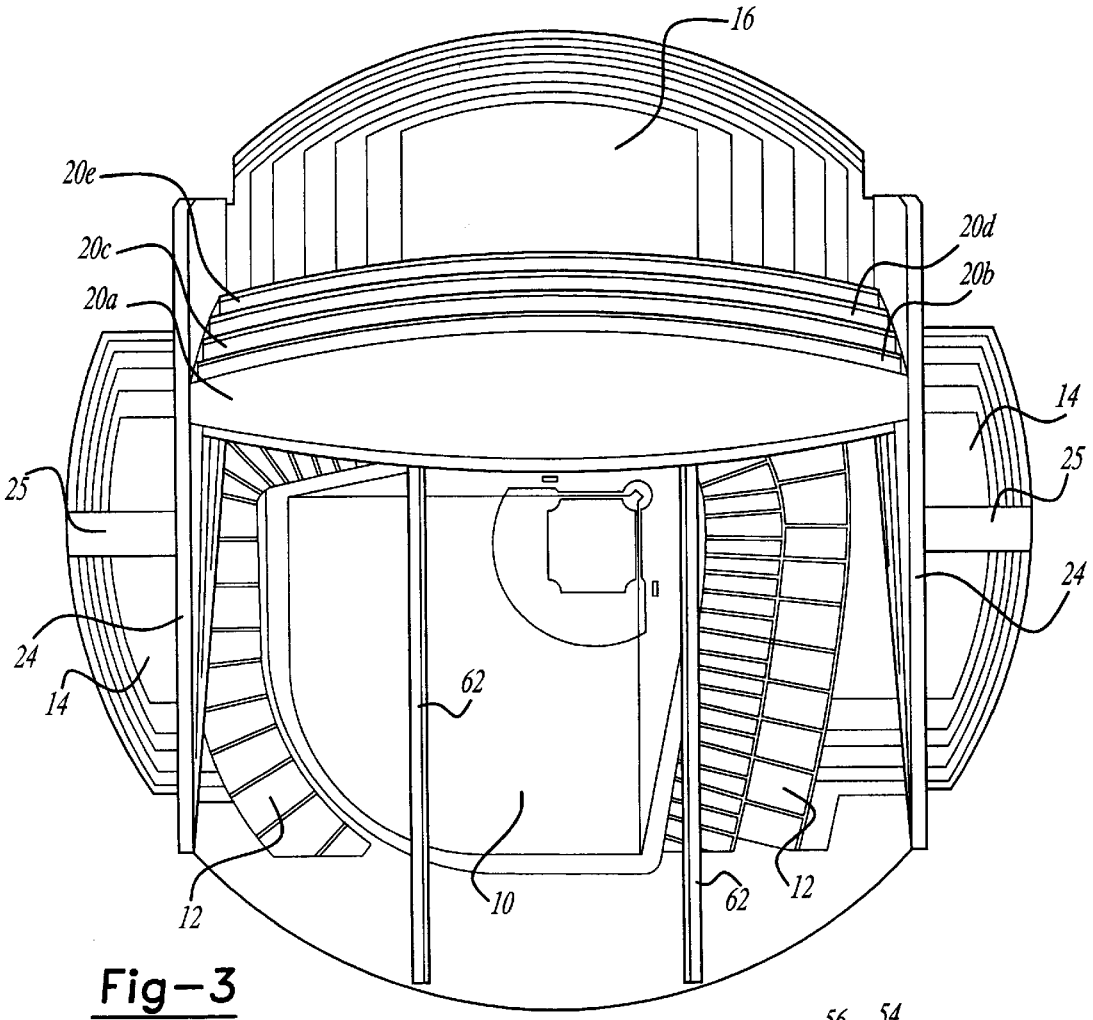
FIG. 3 is a plan view of a retractable dome stadium showing the dome in an open position.
Figure 9:
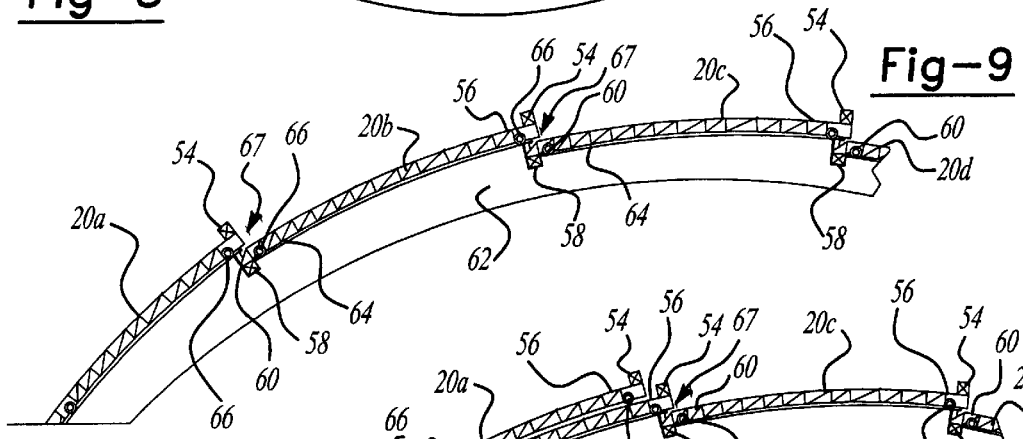

The present stadium is unique in that it can be fully opened and closed utilizing an improved retractable dome arrangement and that it has a low and open view at one end of the stadium that allows fans to see the skyline of a city or other scenic view when the dome is open. The retractable dome includes a plurality of generally lune-shaped dome panels 20*a*–20*d* moveable between a closed position such as shown in FIGS. 2 and 4 in which the panels are disposed generally in a side-by-side relationship to define a generally spherical segment-shaped dome, and an open position such as shown in FIGS. 1 and 3 in which the panels are stacked one above the other. A fixed lune-shaped panel 20*e* is provided adjacent to rear parking levels 16. A lune is the surface of a sphere included between two great circles disposed at a given included angle of inclination. The dome of the present invention approximates a truncated circular segment of a sphere and it is the shape of a truncated lune which is used for each of the moveable dome panels 20*a*–20*d*. In a preferred embodiment of the present invention, the truncated circular segment of the sphere defining the dome extends from approximately ground level 22 to a position disposed above rear parking levels 16. It should also be understood that the dome could also closely approximate a truncated elliptical segment of an ellipsoid. In which case, the dome panels 20*a*–20*d* would still be generally lune-shaped, or in other words shaped like a barrel stave.

Panels 20*a*–20*d* include a first panel 20*a* which extends to approximately ground level 22. By ground level it is generally meant the level of the playing area 10. More specifically, panel 20*a* extends to a level such that when the panels 20*a*–20*d* are retracted, the spectators in the dome have low and open view of a city sky line or other scenic view in one end thereof.

Panels 20*a*–20*d* are supported on arcuate arches 24 disposed at each end thereof. Arches 24 are substantially parallel to one another, being disposed in parallel vertical planes equally spaced from the center of the dome. The overall arc of each arch 24 is the arc defined by the intersection of the vertical plane in which the arch 24 lies in the imaginary sphere of the dome itself. Arches 24 are supported in the lateral direction by buttresses 25 and by the structure of the side parking levels 14. One or more buttresses 25 may be needed on each side of the stadium to provide proper support for arches 24.

Each arch 24 has a flat inclined arcuate surface 26 facing the ends of each panel 20*a*–20*d* and being perpendicular to the longitudinal axis thereof. Surfaces 26 each lie on the plane of a great circle of the imaginary sphere of the dome, and each has on the face thereof a plurality of parallel arcuate slots 28 th rough which extend end supports 30 for each of th e panels 20*a*–20*d*. Each support 30 extends for the full width of each panel 20*a*–20*d* and is in turn supported on its lower surface by means of a plurality of rollers 32. Support 30 has upstanding outer flange 34 supported on opposite sides by a plurality of rollers 36 and 38 and at the upper end of flange 34 is a rack 40 engaged by a pinion 42 driven by a plurality of motors 44. Slots 28, in plan view, are arcs of a circle having the same center as the imaginary sphere of the dome, and are of a length to accommodate the maximum length of travel of the panel or panels (i.e., at opposite sides of the stadium) disposed therein. The motors 44 for each track are spaced apart a distance less than the length of rack 40 so that each panel will always be under the control of at least one motor 44. The same is true for the sets of rollers 32, 36, and 38.

Each support 30 has rigidly affixed thereto a plurality of rods 48 each slidably received within a cylindrical bore 50 at the free end of each panel. Each rod 48 extends generally in the direction of the longitudinal axis of the panel and the inner free-end thereof is connected to a suitable shock-absorbing and/or fluid-type compensating device 52 which is in turn affixed to panels 20*a*–20*d*. Device 52 can be of any desired construction and serves a purpose of dampening flopping movement of the panels under high wind conditions. They also can serve to compensate for thermal expansion and contraction of the entire structure.

Panels 20*a*–20*d* may be of any desired light-weight construction, such as a standard space frame construction with the outer panel skin being either fabric, metal, or other suitable material, or a combination of materials. Panels 20*a*–20*d* are preferably provided with a first support structure 54 extending from an upper surface along a first edge 56 thereof and a second support structure 58 extending from a lower surface along a second edge 60 thereof. The structural design of the panels, rails, and arches can be in accordance with standard engineering and architectural practices based on the anticipated structural and weather loading.

The dome structure can optionally be provided with additional support arches 62, between arches 24, as shown in FIGS. 3 and 9–11. Each support arch 62 is provided with a plurality of arcuate steps 64, one for each panel 20 (FIGS. 9–11), and which lie generally on a great circle of the imaginary sphere defined by the dome. The center of curvature of each step 64 is coincident with the center of the imaginary sphere with the radius of each step surface differing from the adjacent step surface by an amount approximately equal to the thickness of the working panels 20*a*–20*d*. Each panel 20*a*–20*d* has at least two supporting wheels 66 in alignment with each arch 62, and when the dome is closed each panel 20*a*–20*d* is directly supported by arches 62 with the adjacent edges of panels 20*a*–20*d* slightly overlapping one another to provide a weatherproof joint. Panels 20*b* and 20*c* can each be provided with a ridge 67 along a top of edge 60 in order to receive rain water and divert the rain water off of the panels 20*b* and 20*c*. With respect to panels 20*d* and 20*e*, support structures 54 provide the same function. When panels 20*a*–20*d* are retracted to the open position, they roll from arch 62 onto the top surface (properly reinforced) of the next higher panel, and so on until they reach the nested or stacked condition shown in FIGS. 1 and 3.

Figure 10:
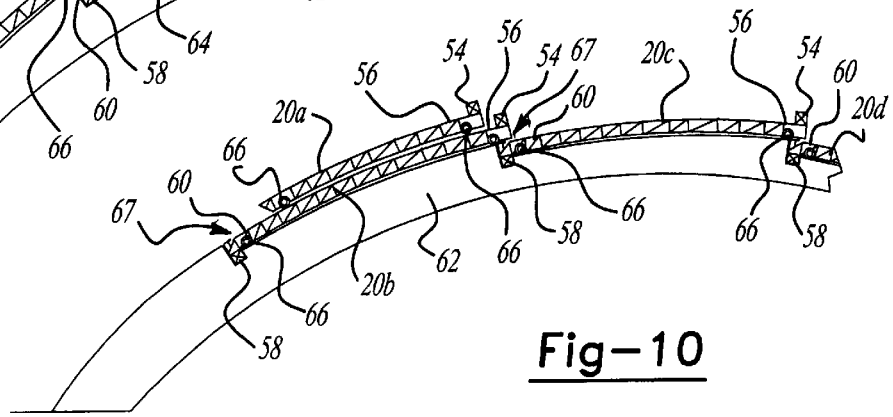
Figure 5:
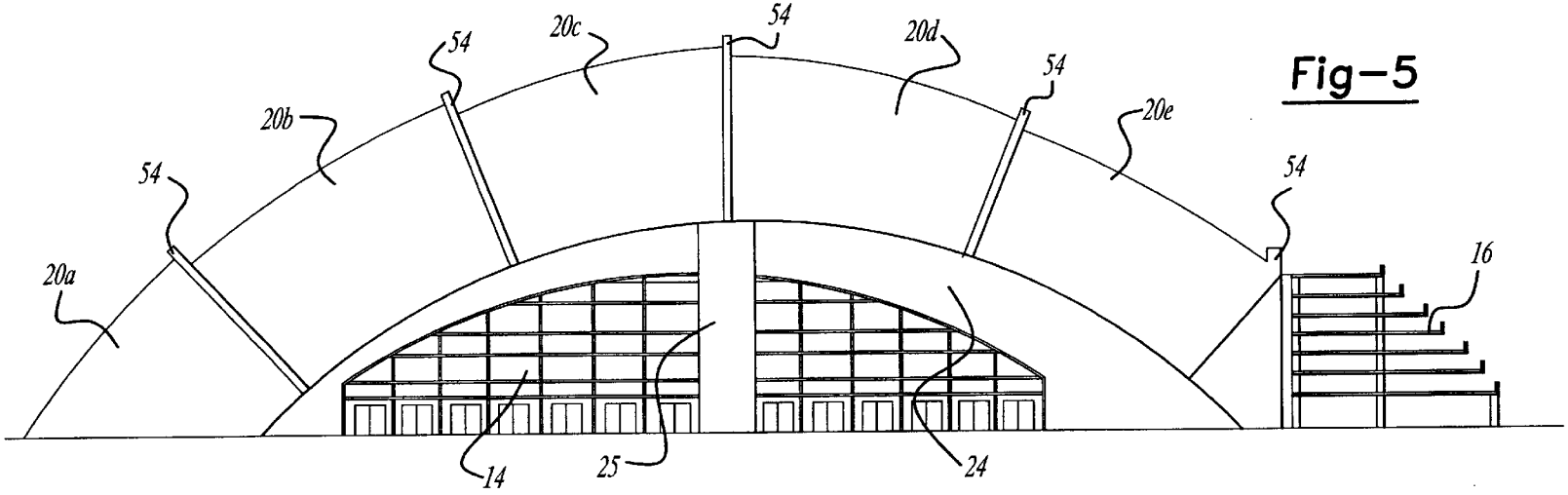
FIG. 5 is a side view of a retractable dome stadium embodying the principles of the present invention, showing the dome in a closed position.
Figure 6:
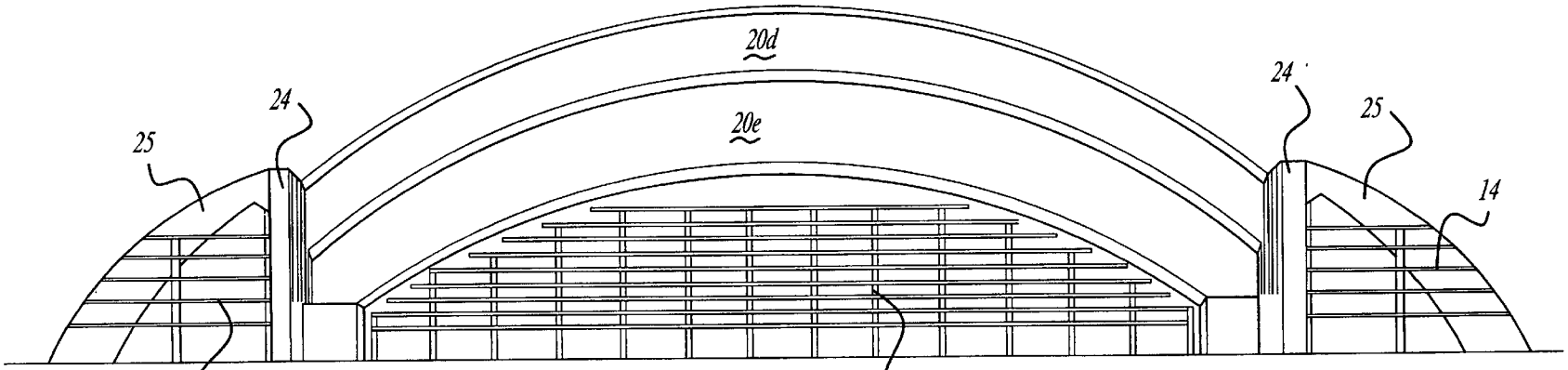
FIG. 6 is a rear view of a retractable dome stadium embodying the principles of the present invention, showing the dome in an open position.
Figure 7:
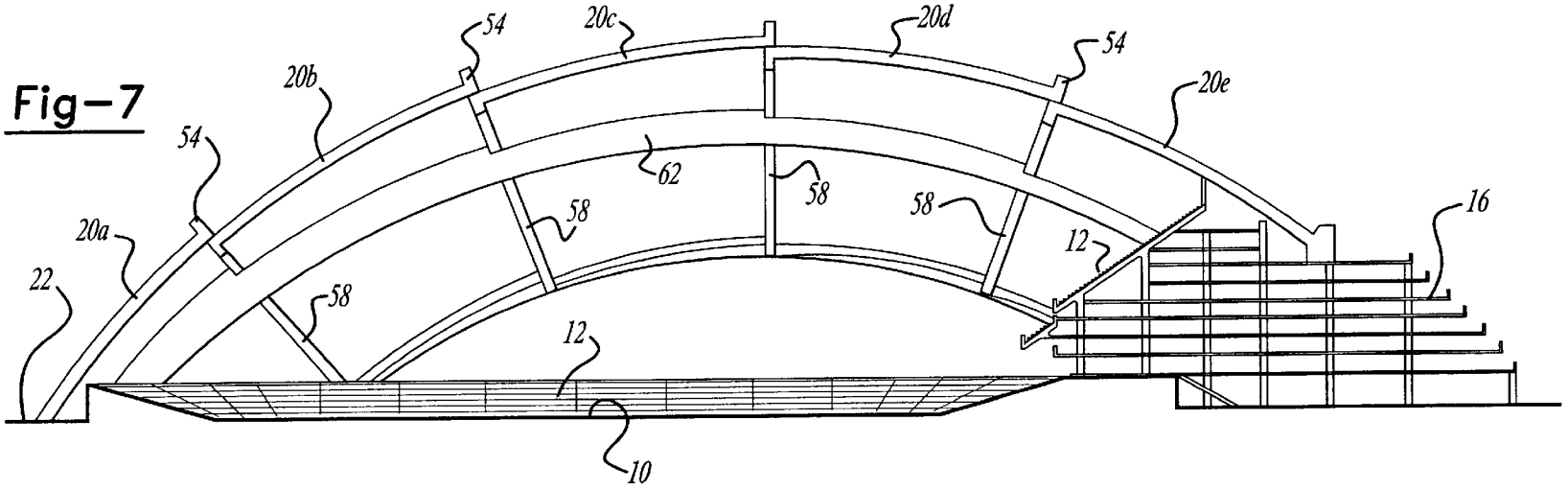
FIG. 7 is a transverse vertical sectional view taken generally along line 7—7 in FIG. 4.
Figure 8:
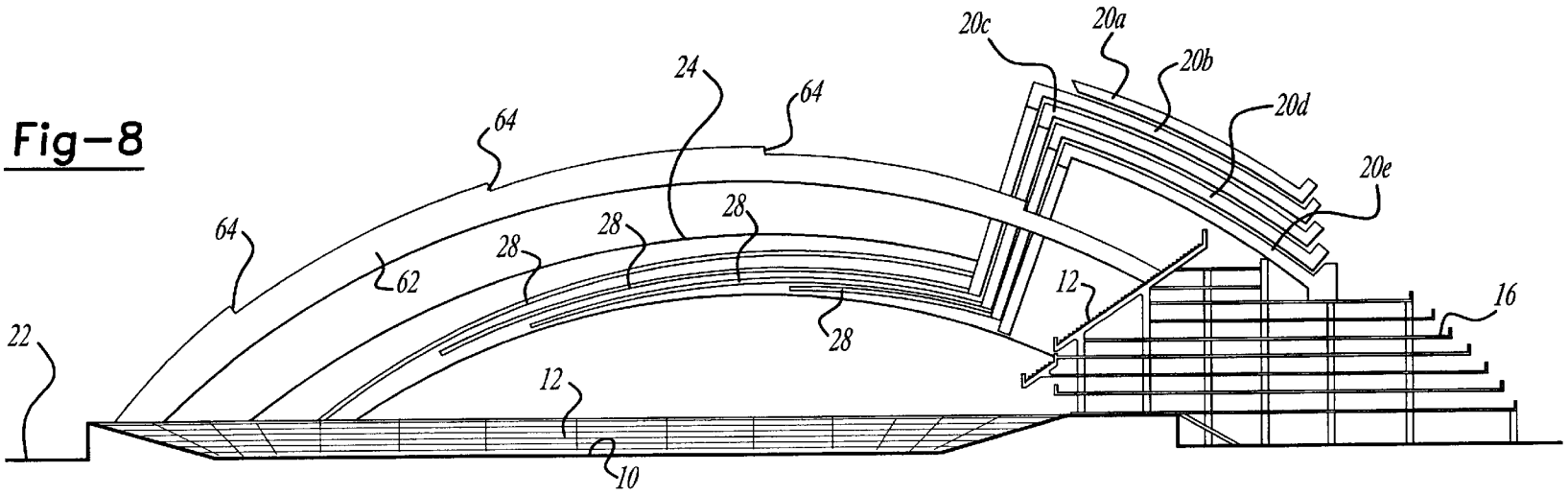
FIG. 8 is a transverse sectional view taken generally along line 8—8 in FIG. 3.
Figure 12:
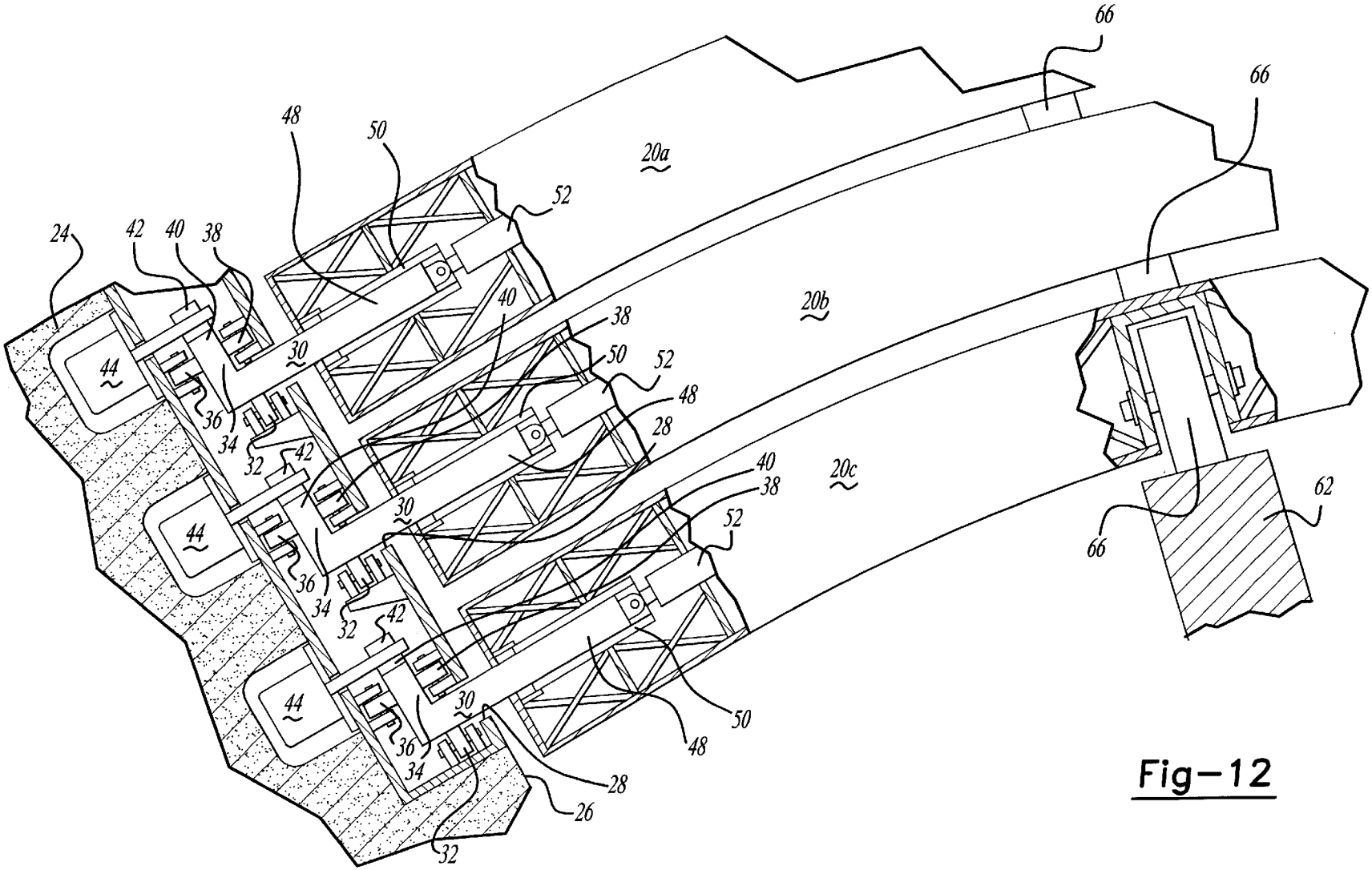
FIG. 12 is an enlarged fragmentary diagrammatic sectional view illustrating the manner in which the ends of the dome panels are supported and actuated, the panels being shown in their open stacked position.

In operation, if the dome is closed it is opened by first actuating the motors 44 in the top slots 28 which control the lower-most panel 20*a* to cause it to start retracting. As the lower-most panel 20*a* retracts, it rolls over the top of the next higher panel 20*b* until the panels 20*a* and 20*b* are fully stacked (FIG. 10). Thereafter, the motors for both these panels 20*a*,20*b* are actuated to cause them both to retract together, (FIG. 11); and so on until the dome is fully opened, or at least opened to the desired extent. The dome may be closed by simply reversing the opening sequence. The panels 20*a*–20*d* move with a generally pivotal-like motion between the open and closed positions. The axis of the motion extends generally through the center of an imaginary spherical segment defined by the panels when they are disposed in the closed position. Operation can be accomplished by using conventional controls, sensors, and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A retractable dome stadium, comprising:

an activity surface having a seating area disposed on one side of said activity surface;

a pair of parallel support members disposed on opposite sides of said activity surface;

a plurality of movable generally lune-shaped panels extending between said parallel support members, said panels moving between an open position in which all of said panels are stacked one above the other in a superimposed relationship on said one side of said activity surface and a closed position in which said panels are disposed in a generally side-by-side relationship including one of said panels extending generally to ground level, said seating area having a low and open view across said activity surface to an area outside of said dome stadium when said panels are in said open position.

2. A retractable dome stadium, comprising:

an activity surface having a seating area disposed on one side;

a pair of arches disposed generally parallel to one another on opposite sides of said activity surface;

a plurality of movable generally lune-shaped panels extending between said arches, said panels moving between an open position in which all of said panels are stacked one above the other in superimposed relationship on said one side of said activity surface and a closed position in which said panels are disposed in a generally side-by-side relationship, wherein said plurality of panels include a first panel which moves from said open stacked position to said closed position at approximately ground level on an opposite side of said activity surface from said seating area during closing of the dome stadium.

3. The retractable dome stadium according to claim 2, further comprising a drive mechanism for moving said panels between said open and closed positions.

4. The retractable dome stadium according to claim 2, further comprising a fixed, lune-shaped panel above which all of said plurality of lune-shaped panels are stacked in said open position.

5. The retractable dome stadium according to claim 2, wherein said dome generally approximates a spherical segment when in the closed position.

6. The retractable dome stadium according to claim 2, wherein said panels move with a generally pivotal-like motion between said positions, an axis of said pivotal-like motion extending generally through a center of an imaginary spherical segment defined by said panels when they are disposed in said closed position.

7. The retractable dome stadium according to claim 2, wherein each of said panels is of truncated lune shape.

8. The retractable dome stadium according to claim 2, wherein said arches include at least one track for movably supporting the ends of one of said panels.

9. The retractable dome stadium according to claim 2, wherein said arches are disposed generally at the intersection of two spaced parallel vertical planes and an imaginary sphere partially defined by said panels when said panels are disposed in said closed position.

10. The retractable dome stadium according to claim 2, wherein said movable lune-shaped panels include a plurality of sets of rollers disposed on a lower surface thereof for engaging an upper surface of another of said panels.

11. The retractable dome according to claim 2, wherein at least one of said movable panels includes a first support structure extending from an upper surface along a first edge thereof and a second support structure extending from a lower surface along an opposite edge thereof.

12. A retractable dome stadium, comprising:

an activity surface having a seating area disposed on one side;

a pair of parallel support members disposed on opposite sides of said activity surface;

a plurality of movable generally lune-shaped panels extending between said parallel support members, said panels moving between an open position in which all of said panels are stacked one above the other in a superimposed relationship and a closed position in which said panels are disposed in a generally side-by-side relationship, wherein said panels move with a generally pivotal-like motion between said positions, an axis of said pivotal-like motion extending generally through a center of an imaginary spherical segment defined by said panels when said panels are disposed in said closed position, and wherein one of said plurality of lune-shaped panels moves from said open stacked position to said closed position at approximately ground level on an opposite side of said activity surface from said seating area such that said seating area has a low and open view across said activity surface to an area outside of said dome stadium when said panels are in said open position.

13. The retractable dome stadium according to claims 12, further comprising a drive mechanism for moving said panels between said open and closed positions.

14. The retractable dome stadium according to claim 12, further comprising a fixed, lune-shaped panel above which all of said plurality of lune-shaped panels are stacked in said open position.

15. The retractable dome stadium according to claim 12, wherein said panels generally approximate a spherical segment when in the closed position.

16. The retractable dome stadium according to claim 12, wherein said panels partially overlap one another in said closed position to provide a substantially weatherproof connection.

17. The retractable dome stadium according to claim 12, wherein each of said panels is of truncated lune shape.

18. The retractable dome stadium according to claim 12, wherein said support members include at least one track for movably supporting the ends of one of said panels.

19. The retractable dome stadium according to claim 12, wherein said support members include arcuate shaped arches disposed generally at the intersection of two spaced parallel vertical planes and an imaginary sphere partially defined by said panels when said panels are disposed in said closed position.

20. The retractable dome stadium according to claim 12, wherein said movable lune-shaped panels include a plurality of sets of rollers disposed on a lower surface thereof for engaging an upper surface of another of said panels.

* * * * *

UNITED STATES PATENT AND TRADEMARK OFFICE

CERTIFICATE OF CORRECTION

PATENT NO. : 5,983,575

DATED : November 16, 1999

INVENTOR(S) : George S. Reppas

It is certified that error appears in the above-identified patent and that said Letters Patent is hereby corrected as shown below:

Column 2, line 66, after "have" insert -- a --.

Column 3, line 16, "th rough" should be -- through --.

Column 3, line 17, "th e" should be -- the --.

Column 5, line 33, after "dome" insert -- stadium --.

Column 6, line 17, "claims" should be -- claim -- .

Signed and Sealed this

First Day of May, 2001

*Attest:*

Nicholas P. Godici

NICHOLAS P. GODICI

*Attesting Officer*

*Acting Director of the United States Patent and Trademark Office*